US006264475B1

(12) United States Patent
Machado

(10) Patent No.: US 6,264,475 B1
(45) Date of Patent: Jul. 24, 2001

(54) COAXIAL RECEPTACE

(75) Inventor: Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 09/571,756

(22) Filed: May 15, 2000

Related U.S. Application Data

(60) Provisional application No. 60/134,825, filed on May 19, 1999.

(51) Int. Cl.[7] ..... H01R 12/00
(52) U.S. Cl. ..... 439/63
(58) Field of Search ..... 439/63, 578, 581, 439/585

(56) References Cited

U.S. PATENT DOCUMENTS

| | | | | |
|---|---|---|---|---|
| 2,891,230 | | 6/1959 | Smith | 439/56 |
| 4,360,244 | | 11/1982 | Forney, Jr. et al. | 439/581 |
| 5,322,453 | | 6/1994 | Resnick et al. | 439/581 |
| 5,466,160 | * | 11/1995 | Ogura | 439/63 |
| 5,580,277 | | 12/1996 | Emery | 439/582 |
| 5,662,480 | | 9/1997 | Togashi | 439/63 |
| 5,752,839 | | 5/1998 | Fiacco et al. | 439/63 |
| 5,772,470 | | 6/1998 | Togashi | 439/582 |
| 6,074,217 | * | 6/2000 | Maruyama et al. | 439/63 |
| 6,152,750 | * | 11/2000 | Huguenet et al. | 439/188 |

OTHER PUBLICATIONS

"Coaxicon® Series MCX Microminiature Coaxial Connectors" pp. 1–2 (Apr. 1, 1999).
"MCX Conductors" pp. 1–3 (Apr, 1. 1999).

* cited by examiner

*Primary Examiner*—Tulsidas Patel
(74) *Attorney, Agent, or Firm*—Hamilton, Brook, Smith & Reynolds, PC

(57) ABSTRACT

A coaxial cable receptacle adapted for attachment to glass which may be used with, for example, a cellular telephone antenna screened directly on the rear window of a vehicle. The receptacle consists of a central insulator portion preferably formed as a cylinder. A pair of solder pads are disposed adjacent the cylinder to provide a ground lead and signal lead to the glass. The solder pad associated with the ground lead is connected to a metallic tab inserted into the top of the insulator cylinder. The signal pad is connected at right angles to a center post placed through the bottom of the center insulator. The receptacle provides a low loss to radio frequency energy while also providing a convenient method through the signal and ground pad for connection to glass.

14 Claims, 4 Drawing Sheets

COAXIAL RECEPTACE

CROSS-REFERENCE TO RELATED APPLICATION(S)

This application claims the benefit of a prior U.S. Provisional Application Ser. No. 60/134,825 filed May 19, 1999 entitled "Coaxial Receptacle," the entire teachings of which are incorporated herein by reference.

BACKGROUND OF THE INVENTION

The present invention relates to coaxial connectors for carrying high frequency radio signals and in particular to a receptacle adapted for attachment to glass.

The widespread availability of wireless telecommunication services such as cellular telephones has created an increasing demand upon the manufacturers of automobiles and automobile accessories to adapt cellular telephone equipment for use in vehicles. One particular artifact of most mobile cellular telephones presently in use is the so-called "pig tail" type antenna which is typically seen mounted to a trunk lid or roof or adjacent the top portion of a rear glass in a vehicle. While this type of antenna works well for its intended purpose, it is prone to breakage either through accident or vandalism. Furthermore, certain owners of luxury and sports cars believe that by attaching an external antenna, they have detracted from the esthetic beauty of their expensive automobile.

This situation has lead to the development of a type of cellular telephone antenna which is screened directly onto the rear glass of a vehicle. This antenna, which is typically created using silk screening techniques analogous to those techniques used to manufacture a heater-defroster element, apply a coating of conductive material in an appropriate pattern on the glass for supporting radio wave propagation and reception.

However, this type of radio antenna which is embedded in the window creates a new problem. In particular, the radio transceiver is typically mounted in the vehicle interior, the trunk, or other place which is out of sight. A coaxial cable is then run from the remotely located transceiver to the window antenna. While in the past there have been developed certain techniques for passing the radio frequency signals from the coaxial cable through the glass to an externally mounted pig tail type antenna, these techniques cannot be directly adapted to connecting to an antenna which is embedded into the window.

SUMMARY OF THE INVENTION

The present invention is a receptacle for use with an antenna such as used with cellular telephone equipment that attaches directly to glass such as in the rear window of a vehicle. The configuration of the receptacle makes it compatible with the glass embedded antenna on one hand as well as being compatible with standard coaxial signaling connectors.

More particularly, the invention consists of a central insulator portion preferably formed in a cylindrical shape. A pair of solder pads are disposed adjacent the cylinder to provide connections to a ground lead and a signal lead on the glass. The solder pad associated with the ground lead is connected to a metallic tab and is inserted into the top of the insulator cylinder. The signal pad is connected at right angles to a center post which is placed through the bottom of the center insulator. The post is adapted to receive the center conductor of a mating coaxial connector. The cylinder insert is adapted and shaped to mate with the outer dimensions of the outer conductor of the meeting coaxial connector.

The receptacle provides low loss to radio frequency energy passing through it while providing, via the ground pad and signal pad, a convenient way to mount to the glass such as with solder. The connector therefore provides a low strain on the glass avoiding breakage of the window. At the same time, a component is provided which may withstand the high temperature extremes encountered in applications such as the placement in a rear window of an automobile.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
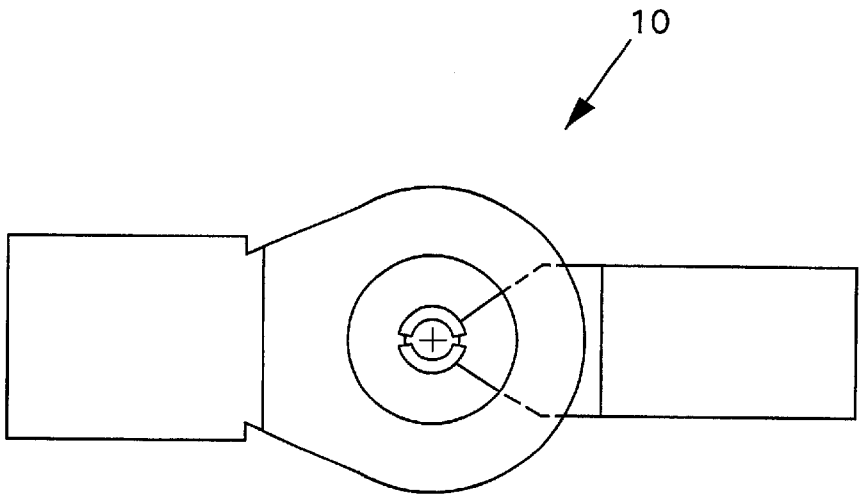
FIGS. 1A and 1B illustrate, respectively, a top view and side cross-sectional view of a coaxial receptacle according to the invention.
Figure 1B:
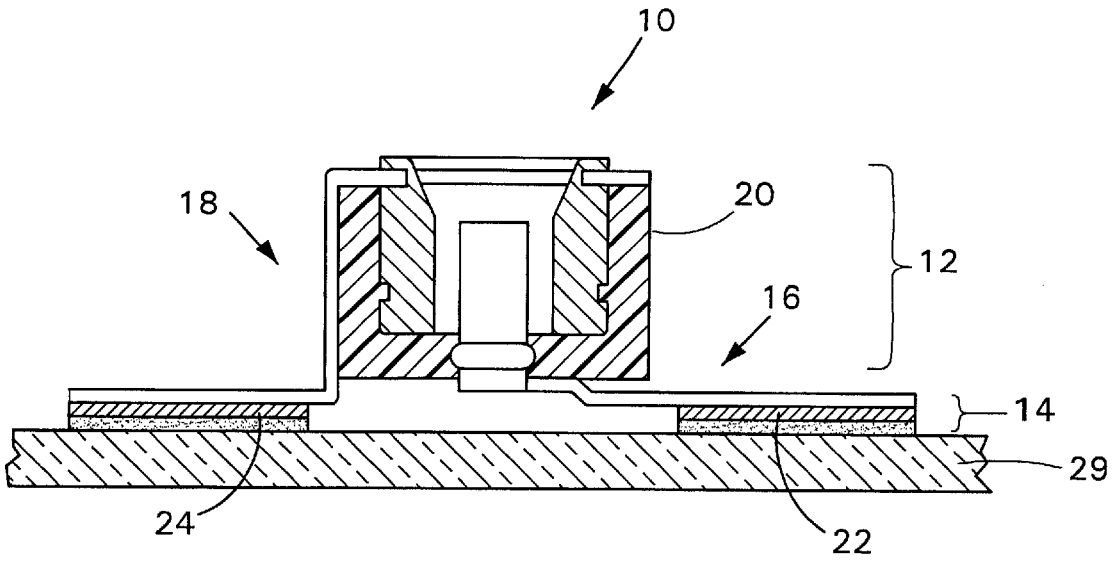

Turning attention now to FIGS. 1A and 1B more particularly, there is shown a coaxial receptacle 10 according to the invention. The receptacle 10 is generally divided into a coaxial connector portion 12 and a solder pad portion 14. The receptacle 10 is formed from essentially three major components, including a central insulating ferrule 20, a signal pad subassembly 16, and a ground pad subassembly 18. The signal pad subassembly 16 carries an electrical signal coupled to the pad 22 to the central portion generally of the connector 10. The ground pad subassembly 18 carries a ground signal coupled to a ground pad 24 to generally the outer portion of the receptacle 10.

Figure 2:
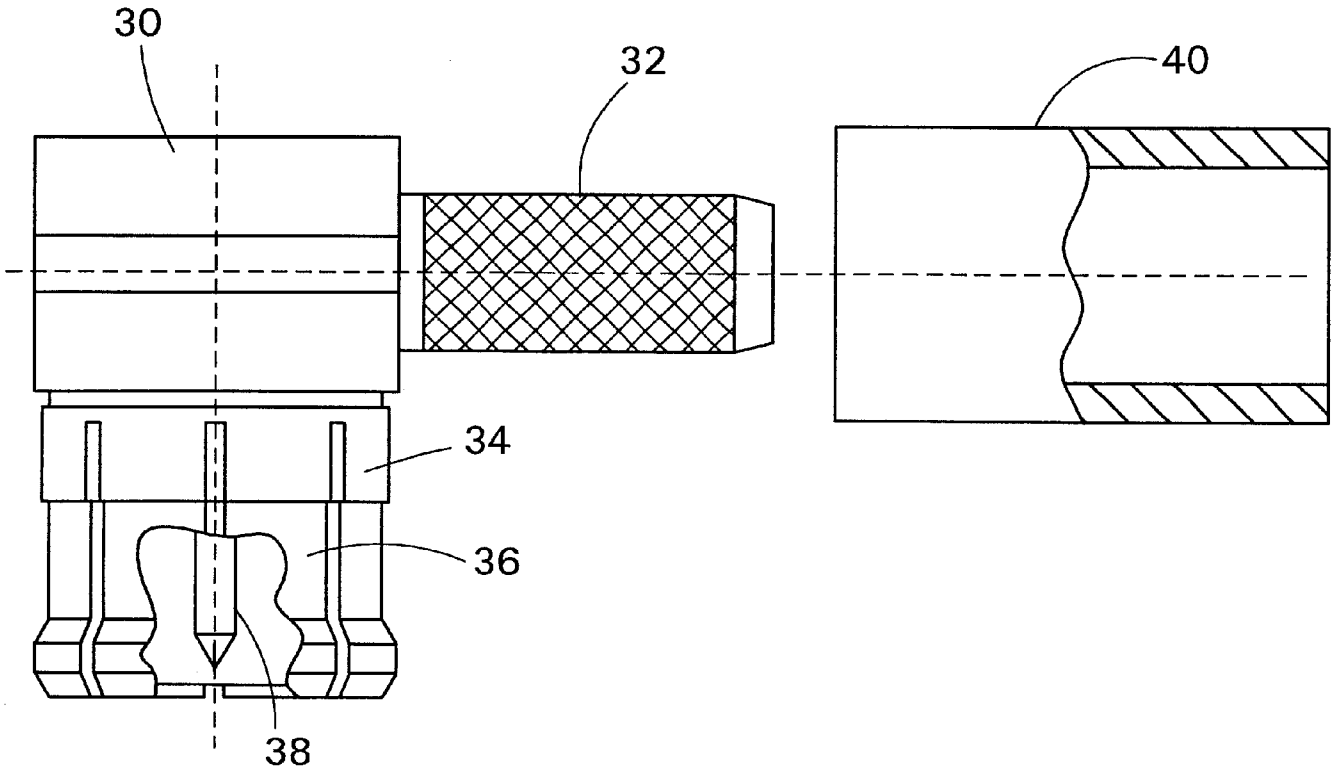
FIG. 2 PRIOR ART
FIG. 2 is a plan view of a coaxial connector that is intended to mate with the coaxial receptacle.

FIG. 2 depicts a coaxial connector 30 which may be used with a receptacle 10 in accordance with the invention. The connector 30 is the type of connector, for example, sold by AMP Incorporated of Harrisburg, Pa. and known as the Coaxicon series of micro-miniature coaxial connectors, part number 829951-1. This type of connector, which is shown by way of example only, is a plug type radio frequency (RF) connector with a right angle style body. Termination is made to a coaxial cable 40 through a crimp type adapter 32. A center contact 38 is typically formed of brass with gold plating. The outer ferrule 34 may be formed of brass or soft copper with gold over nickel plating. This type of coaxial connector 30 typically provides a 50 ohm impedance for signals ranging from up to 3 gigahertz (GHz) in frequency.

The plug portion 34 also has tines 36 which on the lower portion thereof contain an area of increased radius to mate with a corresponding socket. The tines 36 have an outwardly curving portion on the lower end thereof to separately hold the plug in engagement with the corresponding receptacle.

Figure 3A:
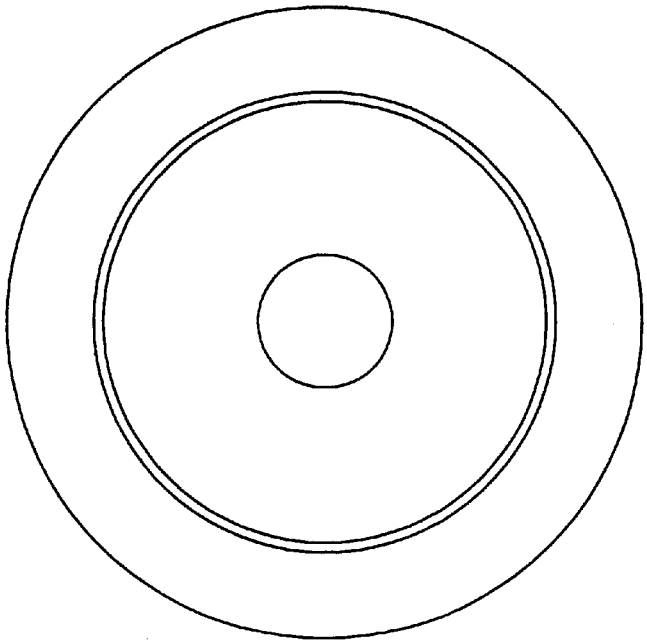
FIGS. 3A and 3B are, respectively, a top view and side cross-sectional view of a central ferrule portion of the coaxial receptacle.
Figure 3B:
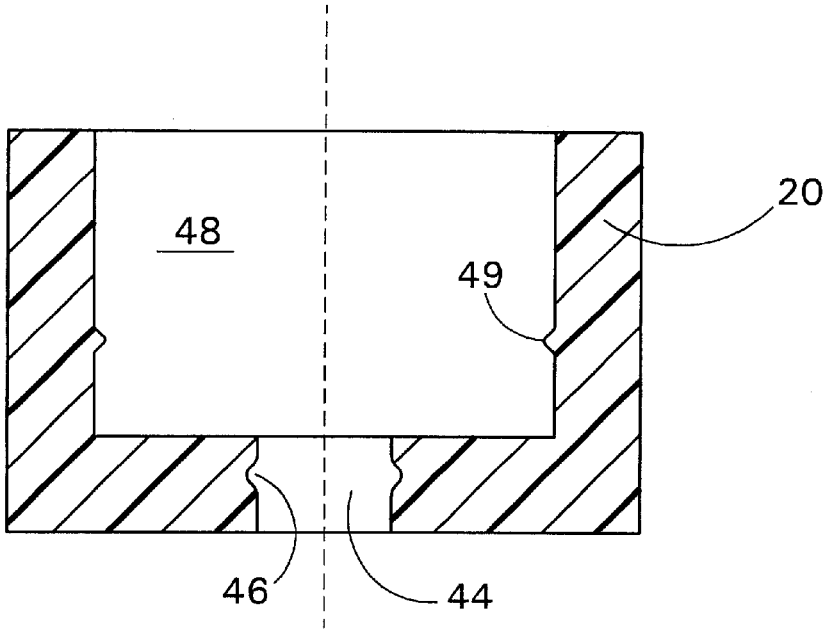

FIGS. 3A and 3B are a more detailed view of the center ferrule 20 of the receptacle 10 according to the present invention. The center ferrule 20 is generally shaped as a cylinder and may be formed of a suitable insulating material such as delrin. The ferrule 20 has a lower opening 44 formed therein typically along the center axis thereof. The inner surface of the opening 44 may have an indentation 46 formed therein. In addition, the center portion 48 of the ferrule 20 may have formed therein a lip 49 along an annular portion approximately in the center region thereof.

Figure 4A:
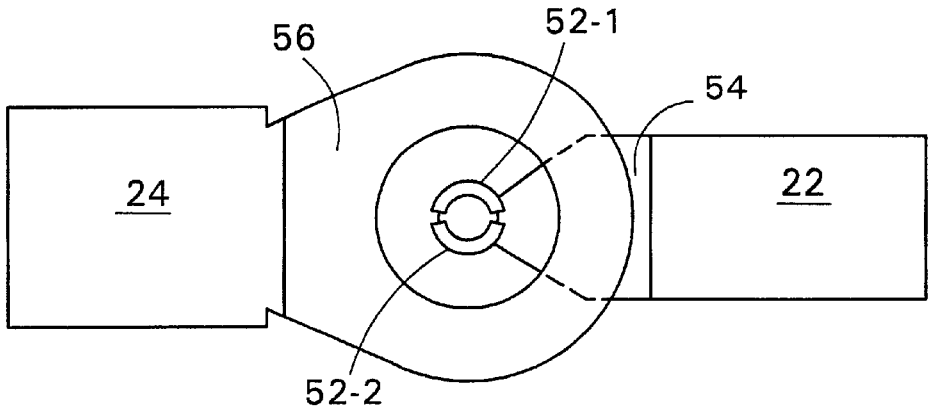
FIGS. 4A and 4B are, respectively, a top view and a side cross-sectional view of a signal pad and ground pad subassembly.
Figure 4B:
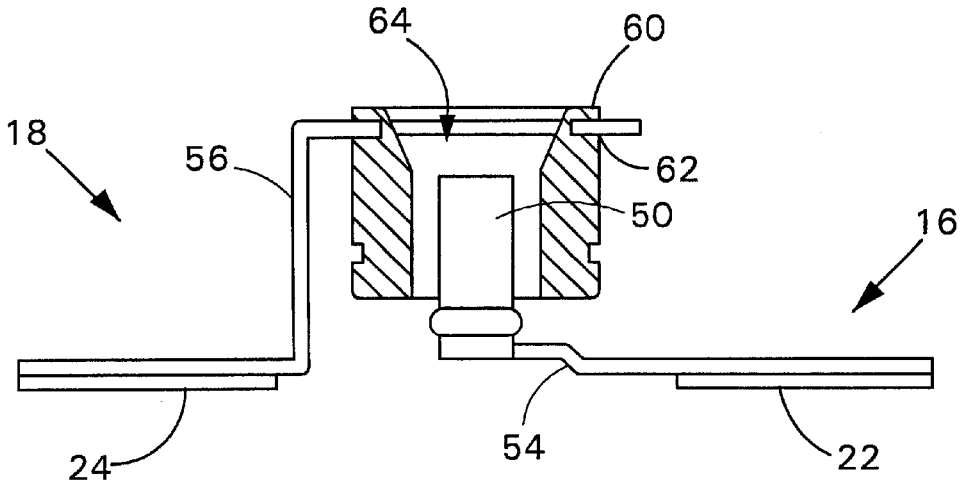

Turning attention now to FIGS. 4A and 4B, the signal pad portions of the receptacle 10 will be described. The signal pad subassembly 16 consists of a signal pin 50 adapted for receiving the center post 38 of the plug 30. The signal pin 50, as best shown in the view of FIG. 4A, may typically be embodied as a pair of facing semi-circular contacts 52-1 and 52-2 with an inner diameter slightly smaller than the outer diameter of the pin 38.

A metallic strip 54 provides a surface on which solder pad 22 may be formed. The strip 54 is formed of a convenient conductive metal such as brass or gold plated brass. The solder pad 22 is preformed with solder and/or solder mixed with flux to enable easy assembly of the receptacle 10 to the glass sub-strait 28.

The ground pad subassembly 18 similarly consists of a metallic cylinder 60 having a notch 62 formed in the upper portion thereof. The notch 62 provides a way to fit a ground strip 56 around the outer periphery thereof. The ground strip 56, as shown, is generally L-shaped in cross section and has an upper portion with a hole 64 formed therein through which the cylinder 50 may fit. The ground tab 56 also provides a support for area for the ground solder pad 24.

The view of FIG. 4B is shown with the center insulating ferrule 20 removed for clarity. However, it should be understood that when the receptacle 10 is fully assembled, the ferrule 20 is in the position shown in the receptacle ferrule 20, signal pad assembly 16, and ground pad assembly 18 are as shown in FIG. 1B.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A receptacle for a sub-miniature Radio Frequency (RF) connector, the receptacle adapted to be attached to at least two signal leads of an RF antenna formed in a glass substrate, the receptacle comprising:

a receptacle body adapted for coupling to the sub-miniature RF connector; and at least two signal pads extending outwards from a lower portion of the receptacle body in a generally planar manner, the signal pads of a generally planar configuration and each signal pad providing a connection to a respective one of the signal leads of the RF antenna, at least one signal pad being formed by a conductive strip secured to an upper exterior portion of the receptacle body and extending downwardly outside the receptacle body to the lower portion, and then extending outwardly therefrom.

2. A receptacle as in claim 1 wherein the receptacle body comprises:

a center ferrule formed of an insulating material having a hole formed in a bottom portion thereof;

a post, being attached to a first one of the signal pads, and the post adapted for insertion into the hole of the center ferrule; and an electrically conductive cylindrical portion, disposed within the receptacle body and connected to a second one of the signal pads.

3. A receptacle as in claim 2 wherein the first signal pad provides a connection to an RF signal.

4. A receptacle as in claim 2 wherein the second signal pad provides a connection to a ground signal.

5. A receptacle as in claim 1 wherein the signal pads provide a solder pad for connecting to a respective one of the signal leads of the RF antenna.

6. A receptacle as in claim 1 wherein the receptacle body comprises a ferrule formed of an insulating material.

7. A receptacle for a sub-miniature radio frequency (RF) connector comprising:

a center ferrule formed of an insulating material having a hole formed in a bottom portion thereof;

a signal post adapted to be placed in the hole formed in the bottom portion of the center ferrule, the signal post having attached thereto a signal pad for attaching to a generally planar lower surface; and an upper ground pad containing a metallic cylindrical portion disposed within the inner portion of the center ferrule for connecting to the outer metallic portion of a coaxial connector, the upper ground pad including a conductive strip secured to the cylindrical portion at an upper exterior portion of the ferrule and extending downwardly outside the ferrule to the bottom portion thereof, and then extending outwardly therefrom.

8. A receptacle as in claim 7 wherein the generally planar surface is a glass substrate having an RF antenna formed thereon.

9. A receptacle as in claim 8 wherein the signal pad attaches to a signal lead of the RF antenna.

10. A receptacle as in claim 8 wherein the ground pad attaches to a ground lead of the RF antenna.

11. An apparatus for providing Radio Frequency (RF) signals to radio equipment located in a vehicle, the apparatus comprising:

a radio transceiver, located in the vehicle, and connected to transmit and receive radio signals through a coaxial RF signal while having an RF connector disposed on an end thereof;

a window of the vehicle, the window having screened thereon a coating of conductive material shaped to form an RF antenna;

a receptacle adapted for receiving the RF connector at the end of the RF signal cable, the receptacle comprising a central receptacle body having a pair of signal pads extending away from a lower portion thereof, the signal pads adapted to be soldered to leads of the RF antenna formed in the glass, at least one signal pad being formed by a conductive strip secured to an upper exterior portion of the receptacle body and extending downwardly outside the receptacle body to the lower portion, and then extending outwardly therefrom.

12. A receptacle as in claim 1 further comprising an electrically conductive cylindrical portion disposed within the receptacle body, the cylindrical portion extending through a hole in the conductive strip for conductive coupling thereto and for securing the conductive strip to the receptacle body.

13. A receptacle as in claim 12 in which a portion of the conductive strip extends across the top of the receptacle body.

14. A receptacle for a sub-miniature Radio Frequency (RF) connector, the receptacle adapted to be attached to at least two signal leads of an RF antenna formed in a glass substrate, the receptacle comprising:

a receptacle body adapted for coupling to the sub-miniature RF connector;

at least two signal pads extending outwards from a lower portion of the receptacle body in a generally planar manner, the signal pads of a generally planar configuration and each signal pad providing a connection to a respective one of the signal leads of the RF antenna, at least one signal pad being formed by a conductive strip secured to an upper exterior portion of the receptacle body and extending downwardly outside the receptacle body to the lower portion, and then extending outwardly therefrom; and an electrically conductive cylindrical portion disposed within the receptacle body, the cylindrical portion extending through a hole in the conductive strip for conductive coupling of the periphery of the cylindrical portion thereto and for securing the conductive strip to the receptacle body.

* * * * *